US008419235B2

(12) United States Patent
Chen et al.

(10) Patent No.: US 8,419,235 B2
(45) Date of Patent: Apr. 16, 2013

(54) LIGHTING SYSTEM

(75) Inventors: Tai-Sheng Chen, Taipei (TW); Hsun-Li Huang, Taipei County (TW); Mong-Yong Sim, Taipei (TW); Jiung-Cheng Pan, Taipei (TW); Ho-Tsung Hsueh, Taipei County (TW); Wen-Ming Wu, Taipei (TW); Cheng-En Wu, Taipei (TW)

(73) Assignee: Qisda Corporation, Taoyuan County (TW)

( * ) Notice: Subject to any disclaimer, the term of this patent is extended or adjusted under 35 U.S.C. 154(b) by 685 days.

(21) Appl. No.: 12/648,334

(22) Filed: Dec. 29, 2009

(65) Prior Publication Data

US 2010/0164411 A1 Jul. 1, 2010

(30) Foreign Application Priority Data

Dec. 30, 2008 (TW) ..... 97151505 A

(51) Int. Cl.
*F21S 10/00* (2006.01)

(52) U.S. Cl.
USPC ..... 362/367; 362/219; 362/224; 362/225; 362/249.03; 362/249.07; 362/249.1; 362/249.12; 362/249.01; 362/371; 362/418; 362/427; 315/362; 200/4; 200/60; 200/61.39; 200/564; 200/566; 200/567

(58) Field of Classification Search ..... 362/219, 362/224, 225, 249.03, 249.07, 249.1, 249.12, 362/249.13, 249.01, 367, 371, 418, 427; 315/362; 200/4, 60, 61.39, 61.45 M, 564, 200/566, 567
See application file for complete search history.

(56) References Cited

U.S. PATENT DOCUMENTS

| | | | | |
|---|---|---|---|---|
| 2,878,373 | A | 3/1959 | Bramming | |
| 4,052,864 | A * | 10/1977 | Hofsaess | 63/31 |
| 5,688,037 | A | 11/1997 | Chen | |
| 5,842,780 | A * | 12/1998 | Causby et al. | 362/394 |
| 6,170,960 | B1 | 1/2001 | Maglica | |
| 7,070,305 | B2 * | 7/2006 | Chen | 362/295 |
| 2002/0125679 | A1 * | 9/2002 | Jung | 280/288.4 |
| 2004/0004828 | A1 * | 1/2004 | Chernick et al. | 362/35 |
| 2004/0055524 | A1 * | 3/2004 | Lin | 116/264 |
| 2004/0120142 | A1 * | 6/2004 | Galli | 362/191 |
| 2005/0157496 | A1 * | 7/2005 | Chen | 362/243 |

* cited by examiner

*Primary Examiner* — Mary McManmon

(57) ABSTRACT

A lighting system including a powering rod and a first lighting unit is provided. The powering rod is used for providing power. The first lighting unit includes a housing, a light source, an inner ring body and an outer ring body. The light source is disposed inside the housing. The inner ring body, disposed in the housing, has a hollowed portion for receiving the powering rod and is electrically connected to the powering rod. The outer ring body, disposed on the inner ring body fixed to the housing. The outer ring body is capable of rotating with respect to the inner ring body for rotating the housing. When the outer ring body is rotated to a first position, the first lighting unit is in a first lighting state. When the outer ring body is rotated to a second position, the first lighting unit is in a second lighting state.

20 Claims, 6 Drawing Sheets

LIGHTING SYSTEM

This application claims the benefit of Taiwan application Serial No. 97151505, filed Dec. 30, 2008, the subject matter of which is incorporated herein by reference.

BACKGROUND OF THE INVENTION

1. Field of the Invention

The invention relates in general to a lighting system, and more particularly to a lighting system capable of changing lighting states.

2. Description of the Related Art

Lighting devices play an important role in people's everyday life. No matter the nighttime illumination or the indoor illumination in the daytime, people need the lighting devices to provide necessary light source.

Under different circumstances, the user may wish that lighting devices can provide different brightness levels or different lighting states. If lighting devices can provide a light source and at the same time provide delightful and ornamental functions, people's life would be more interesting and more versatile. Thus, how to provide a lighting device that meets the above objects has become an important direction to the illumination industry.

SUMMARY OF THE INVENTION

The invention is directed to a lighting system with many lighting states. Through simple operation, the user can promptly change the brightness or the lighting states of the lighting system. The lighting system of the invention indeed provides excellent convenience. Besides, the invention, providing both delightful and ornamental functions, meets the user's needs of a quality living standard.

According to a first aspect of the present invention, a lighting system including a powering rod and a first lighting unit is provided. The powering rod is used for providing power. The first lighting unit includes a housing, a light source, an inner ring body and an outer ring body. The light source is disposed inside the housing. The inner ring body, disposed in the housing, has a hollowed portion for receiving the powering rod and is electrically connected to the powering rod. The outer ring body, disposed on the inner ring body fixed to the housing. The outer ring body is capable of rotating with respect to the inner ring body for rotating the housing. When the outer ring body is rotated to a first position, the first lighting unit is in a first lighting state. When the outer ring body is rotated to a second position, the first lighting unit is in a second lighting state.

The invention will become apparent from the following detailed description of the preferred but non-limiting embodiments. The following description is made with reference to the accompanying drawings.

DETAILED DESCRIPTION OF THE INVENTION

The invention provides a lighting system including a powering rod and a first lighting unit. The powering rod is used for providing power. The first lighting unit includes a housing, a light source, an inner ring body and an outer ring body. The light source is disposed inside the housing. The inner ring body, disposed in the housing, has a hollowed portion for receiving the powering rod. The inner ring body is electrically connected to the powering rod. The outer ring body, disposed on the inner ring body, is fixed to the housing. The outer ring body is capable of rotating with respect to the inner ring body for rotating the housing correspondingly. When the outer ring body is rotated to a first position, the first lighting unit is in a first lighting state, and when the outer ring body is rotated to a second position, the first lighting unit is in a second lighting state. Through simple operation, the user can promptly change the brightness or the lighting states of the lighting system. The lighting system of the invention indeed provides excellent convenience. Besides, the invention, providing both delightful and ornamental functions, meets the user's needs of a quality living standard. The invention is exemplified by a number of embodiments below.

First Embodiment

Figure 1:
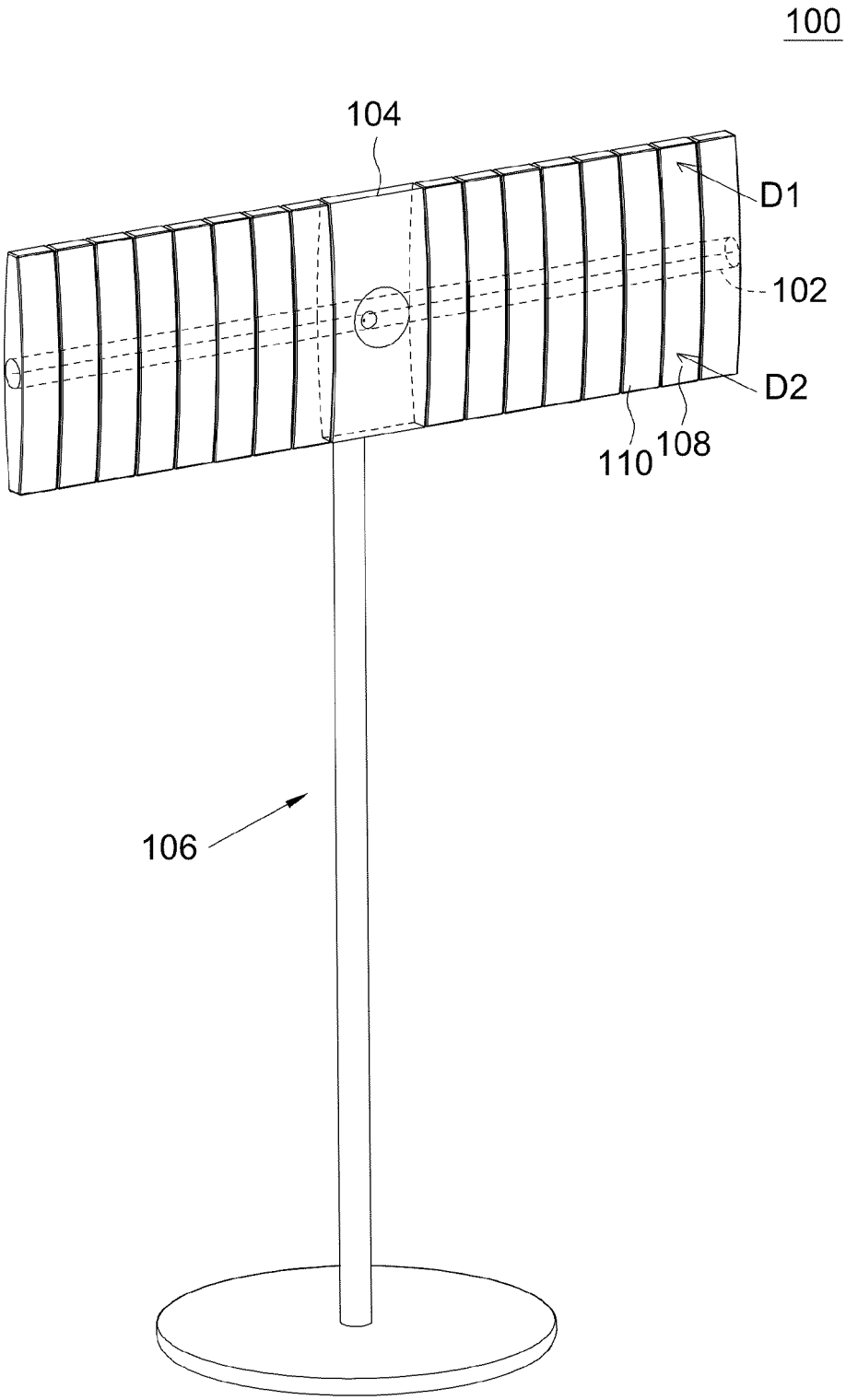
FIG. 1 shows a lighting system according to a first embodiment of the invention.

Referring to FIG. 1, a lighting system according to a first embodiment of the invention is shown. The lighting system 100 includes a powering rod 102, at least one lighting unit, a main control unit 104, and a supporter 106. The at least one lighting unit is connected to a lateral side of the main control unit 104. The supporter 106 supports the at least one lighting unit and the main control unit 104. The at least one lighting unit includes a first lighting unit 108 and a second lighting unit 110 for example. In the present embodiment of the invention, the supporter 106 is used for carrying the lamps. The lamps can also be hanged from the ceiling or setting on the wall.

Figure 2:
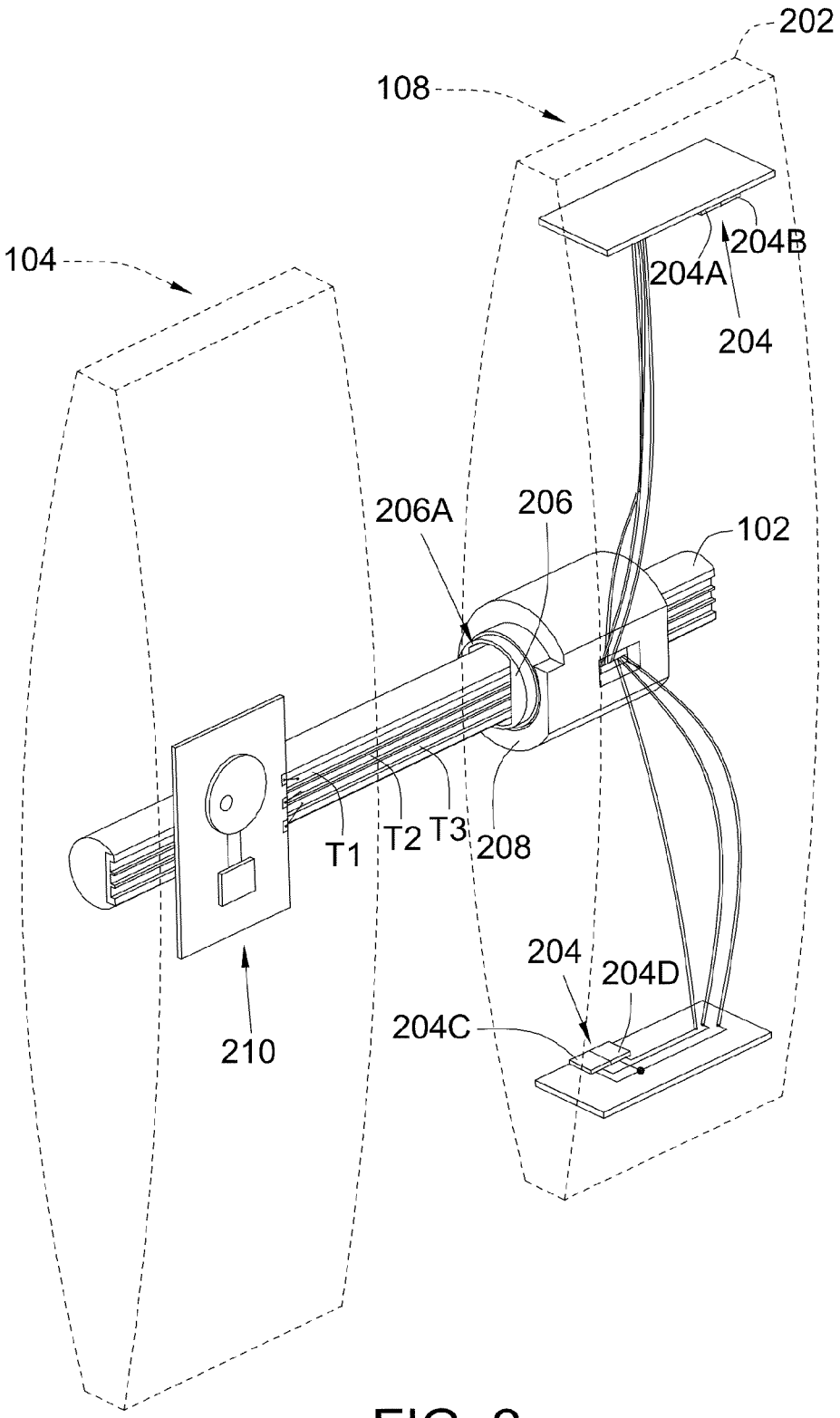
FIG. 2 shows a partial structural diagram of the lighting system of FIG. 1.

Referring to FIG. 2, a partial structural diagram of the lighting system of FIG. 1 is shown. The powering rod 102 is used for providing power or a control signal. The first lighting unit 108 includes a housing 202, a light source 204, an inner ring body 206 and an outer ring body 208. The light source 204 is disposed inside the housing 202. The inner ring body 206 is disposed in the housing 202. The inner ring body 206 has a hollowed portion 206A for receiving the powering rod 102. The inner ring body 206 is electrically connected to the powering rod 102. The outer ring body 208, disposed on the inner ring body 206, is fixed to the housing 202. The outer ring body 208 is capable of rotating with respect to the inner ring body 206 for rotating the housing 202 correspondingly.

Figure 3A:
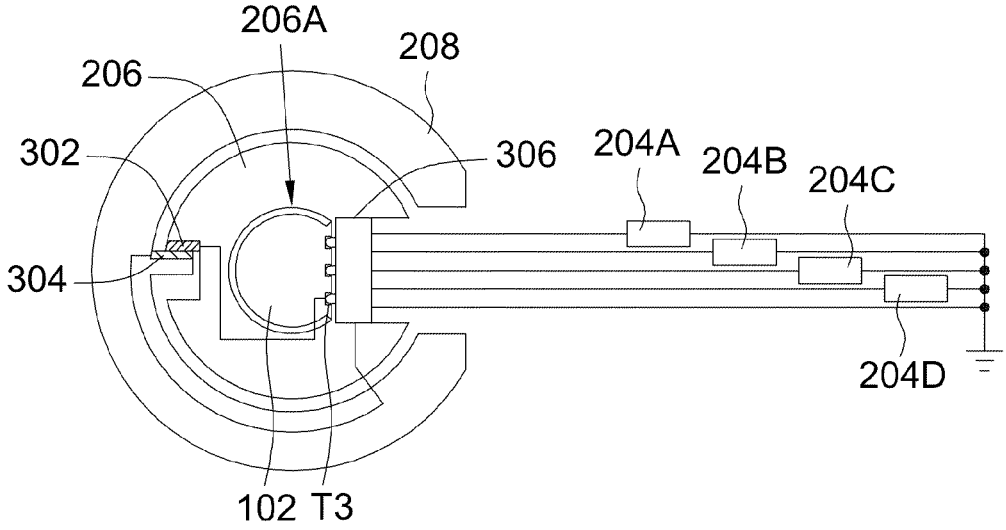
FIG. 3A and FIG. 3B show cross-sectional views of a portion of the lighting system along a cross-sectional line 3A-3A'.
Figure 3B:
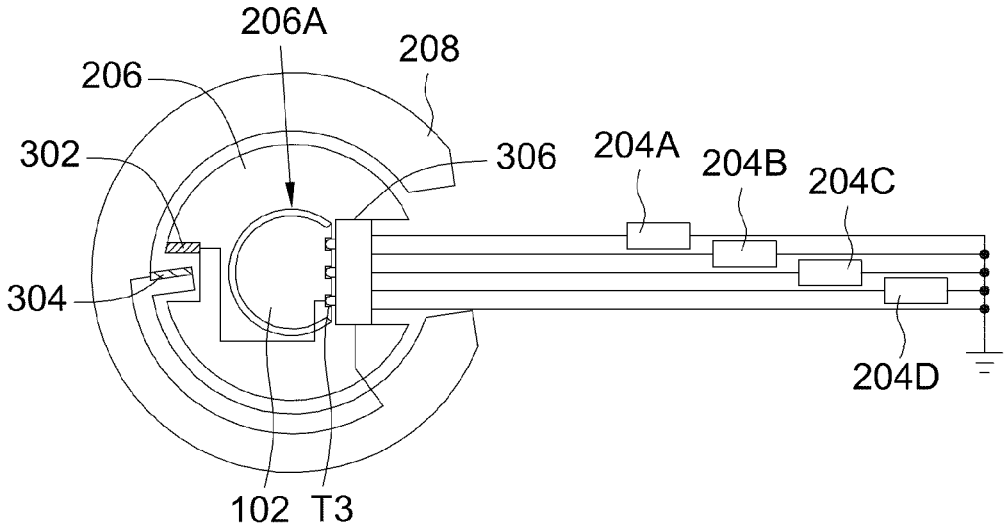

Referring to FIG. 3A and FIG. 3B, cross-sectional views of a portion of the lighting system 100 along a cross-sectional line 3A-3A' are shown. FIG. 3A shows a cross-sectional view of the outer ring body 208 rotated to a first position with respect to the inner ring body 206. FIG. 3B shows a cross-sectional view of the outer ring body 208 rotated to a second position with respect to the inner ring body 206. When the outer ring body 208 is rotated to the first position, the first lighting unit 108 is in a first lighting state. When the outer ring body 208 is rotated to a second position, the first lighting unit 108 is in a second lighting state.

For example, the first lighting state is bright state, and the second lighting state is dark state. As shown in FIG. 3A, the inner ring body 206 has a first metal conductor 302, and the outer ring body 208 has a second metal conductor 304. When the outer ring body 208 is at the first position, the first metal conductor 302 and the second metal conductor 304 are electrically connected, the power transmitted from the powering rod 102 is transmitted to the light source 204 through the inner ring body 206 and the outer ring body 208, so that the first lighting unit 108 is in the bright state.

As indicated in FIG. 3B, the outer ring body 208 is at the second position, wherein the first metal conductor 302 and the second metal conductor 304 are not electrically connected. Meanwhile, the power transmitted from the powering rod 102 is not transmitted to the light source 204, so that the first lighting unit 108 is in the dark state.

According to one implementation of the present embodiment of the invention, whether the first lighting unit 108 is in the bright state or the dark state is based on whether the power providing or not. Let the conducting wires T1 and T2 be used for providing power, such as a DC voltage, and the conducting wire T3 be coupled to a ground voltage. When the outer ring body 208 is at the first position, the first metal conductor 302 and the second metal conductor 304 are electrically connected, so that the ground voltage transmitted through the conducting wire T3 can be transmitted to one end of the light source 204, the current path of the light source 204 is conducted, the light source 204 radiates light, and the first lighting unit 108 is in the bright state. When the outer ring body 208 is at the second position, the first metal conductor 302 and the second metal conductor 304 are not electrically connected, so that the ground voltage transmitted through the conducting wire T3 cannot be transmitted to one end of the light source 204, the current path of the light source 204 cannot be conducted, the light source 204 turns off, and the first lighting unit 108 is in the dark state.

According to another implementation of the present embodiment of the invention, the first lighting unit 108 further includes a first control circuit 306 coupled to the light source 204. As indicated in FIG. 2, the lighting system 100 further includes a control unit 210 connected to the powering rod 102. The control unit 210 provides a control signal to the first control circuit 306 through the powering rod 102 for controlling the light source 204.

Let the control signal be transmitted through the conducting wire T3, and the light source 204 includes four light emitters 204A, 204B, 204C and 204D. When the outer ring body 208 is at the first position, the first metal conductor 302 and the second metal conductor 304 are electrically connected, so that the control signal transmitted through the conducting wire T3 can be transmitted to the first control circuit 306. After the first control circuit 306 receives the control signal from the control unit 210, the first control circuit 306 correspondingly controls the light emitters 204A, 204B, 204C and 204D.

The first lighting state is not limited to the bright state, and nor is the second lighting state be limited to the dark state. When the first lighting unit 108 is selectively in the first lighting state and the second lighting state, the light emitters 204A~204D selectively turning on or off. For example, when in the first lighting state, the light emitters 204A and 204B radiate light, but the light emitters 204C and 204D turning off, and when in the second lighting state, the light emitters 204C and 204D radiate light, but the light emitter 204A and 204B turning off.

Or, the first lighting state is a first bright state, the second lighting state is a second bright state, and the first bright state and the second bright state may differ with each other in terms of brightness, color, illuminating direction or light emitting position. For example, when in the first bright state, only the light emitters 204A~204C radiate light, and when in the second bright state, only the light emitter 204D radiates light. Thus, different brightness levels can be generated in the first bright state and the second bright state. Or, when in the first bright state, only the light emitters 204A and 204B radiate a first color light, and when in the second bright state, only the light emitters 204C and 204D radiate two color lights. Thus, different colors are generated in the first bright state and the second bright state.

Or, the first lighting unit 108 can have two extra light guide plates (not illustrated in the diagram), wherein one light guide plate is disposed at the front for guiding the light emitted by the light emitter 204A and 204B, and the other light guide plate is disposed at the rear end for guiding the light emitted by the light emitters 204C and 204D. When in the first bright state, only the light emitters 204A and 204B radiate, so that the first lighting unit 108 radiates only at the front end. When in the second bright state, only the light emitters 204C and 204D radiate, so that the first lighting unit 108 radiates light only at the rear end. Thus, different illuminating directions can be generated in the first bright state and the second bright state.

Or, when in the first bright state, only the light emitters 204A and 204B radiate light, so that the first lighting unit 108 radiate light only at the top. When in the second bright state, only the light emitters 204C and 204D radiate, so that the first lighting unit 108 radiate only at the bottom. Thus, different light emitting positions can be generated in the first bright state and the second bright state.

Besides, the structure of the second lighting unit 110 is the same with that of the first lighting unit 108. The second lighting unit 110 can also receive the powering rod 102. The control unit 210 sets the addresses of the first lighting unit 108 and the second lighting unit 110 and further controls the first lighting unit 108 and the second lighting unit 110 according to the addresses being set.

Figure 4A:
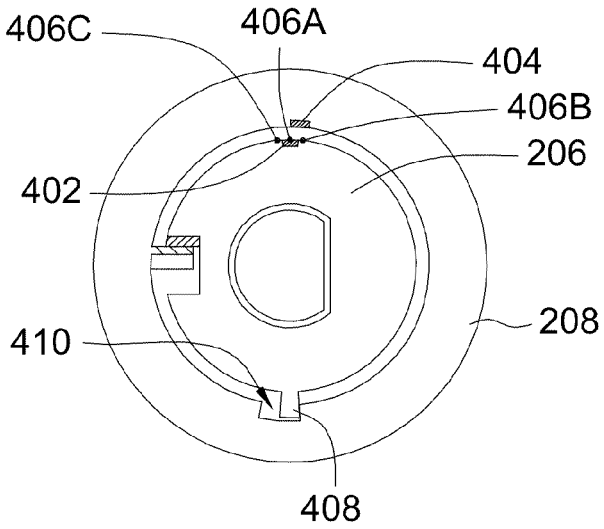
FIG. 4A~FIG. 4C shows cross-sectional view of a portion of a lighting system along a cross-sectional line 4A-4A'.
Figure 4B:
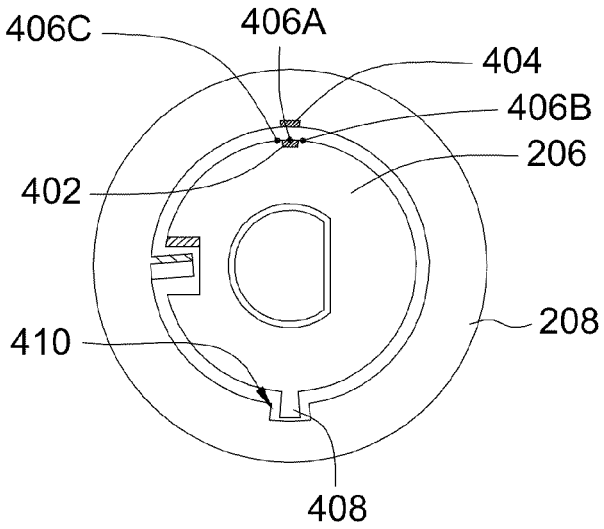
Figure 4C:
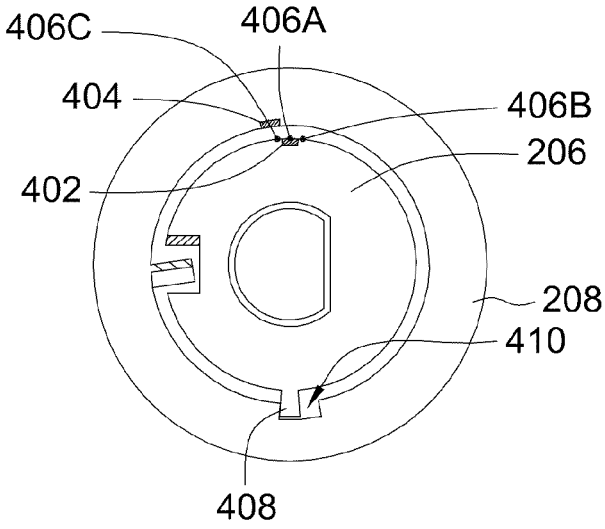

Referring to FIG. 4A~FIG. 4C, cross-sectional views of a portion of a lighting system 100 along a cross-sectional line 4A-4A' are shown. FIG. 4A shows a cross-sectional view of the outer ring body 208 rotated to a first position with respect to the inner ring body 206. FIG. 4C shows a cross-sectional view of the outer ring body 208 rotated to a second position with respect to the inner ring body 206. FIG. 4B shows a cross-sectional view of the outer ring body 208 rotated to a third position located between the first position and the second position with respect to the inner ring body 206 the inner ring body 206.

A first magnet 402 is disposed on the inner ring body 206. A second magnet 404 is disposed on the outer ring body 208. The first magnet 402 and the second magnet 404 face each other with the same polarity when the outer ring body 208 is rotated between the first position and the second position, so that the outer ring body 208 is at the first position or the second position.

For example, the first magnet 402 is disposed at a first point 406A on the relative circumference of the inner ring body 206. When the outer ring body 208 is at the first position, the second magnet 404 faces a second point 406B on the inner ring body 206. When the outer ring body 208 is at the second position, the second magnet 404 faces a third point 406C on the inner ring body 206. The first point 406A is located between the second point 406B and the third point 406C, and repulsion of the same polarity occurs when the first magnet 402 and the second magnet 404 face each other with the same polarity.

Through the use of the magnets, the repulsive force of the magnet enables the outer ring body 208 to be firmly stationed at the first position or the second position and free of wobbling during rotation. The repulsive force of magnets further provides the force required for the first metal conductor 302 and the second metal conductor 304 to contact each other, and makes the lighting unit switch between different lighting states more smoothly.

Besides, the inner ring body 206 can further have protrusion 408, and the outer ring body 208 can further have a recess 410. The recess 410 is used for receiving the protrusion 408 to limit the outer ring body 208 to rotate between the first position and the second position.

As indicated in FIG. 1, when using the lighting system 100, the user may apply a force onto the housing 202 along the direction D1 or the direction D2 to drive the first lighting unit 108 to rotate around the powering rod 102. The housing 202, after rotation, drives the outer ring body 208 fixed to the housing 202 to rotate with respect to the inner ring body 206 so that the outer ring body 208 is rotated to the second position from the first position or is rotated to the first position from the second position.

The first lighting unit 108 and the second lighting unit 110 are capable of independently rotating with respect to the powering rod 102. When the first lighting unit 108 is at the first position, the first lighting unit 108 is parallel to the housing of the second lighting unit 110. When the first lighting unit 108 is at the second position, the first lighting unit 108 faces the second lighting unit 110 at a pre-determined angle being larger or equal to 5 degrees.

The light source 204 disclosed above can be implemented by a light emitting diode (LED), an organic light emitting diode (OLED), an incandescent lamp, or other elements that radiate light by providing power.

The user can change the lighting state of a lighting unit by touching the lighting unit lightly. Thus, the user can promptly change the lighting state of a lighting unit through simple operation. In the present embodiment of the invention, the lighting unit has the function of rotary switch. As each lighting unit can be switched independently, the user only needs to increase the number of the lighting units being in the bright state in order to improve the overall brightness of the lighting system, hence achieving excellent convenience in use.

Moreover, as each lighting unit can be independently operated and rotated with respect to the powering rod 102, the user can determine the number and the positions of the lighting units to be switched on so that different combinations of the lighting states can be generated. For example, the user can adjust the lighting unit to alternate between a dark state and a bright state. The user can change the luminous effect of the lighting system 100 according to his/her moods or situations, so that the lighting system 100 of the present embodiment of the invention provides both delightful and ornamental functions and meets the user's needs of a quality living standard.

Second Embodiment

Figure 5A:
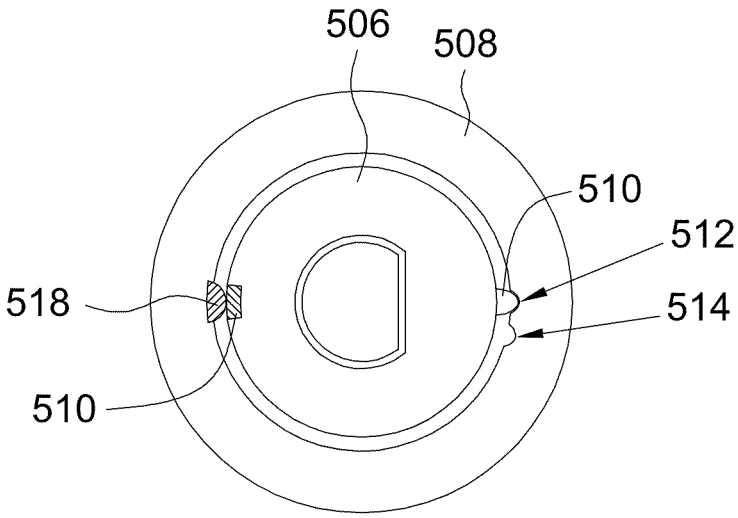
FIG. 5A and FIG. 5B show cross-sectional views of a portion of a lighting system according to a second embodiment of the invention.
Figure 5B:
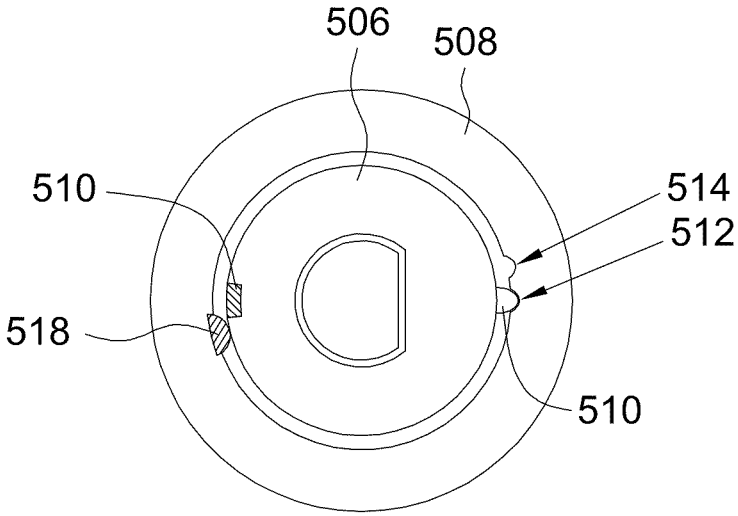

Referring to FIG. 5A and FIG. 5B, cross-sectional views of a portion of a lighting system according to a second embodiment of the invention are shown. FIG. 5A and FIG. 5B differs with FIG. 4A and FIG. 4C of the first embodiment in that the inner ring body 506 has a protrusion 510, and that the outer ring body 508 has a first recess 512 and a second recess 514. The protrusion 510 is received in the first recess 512 or the second recess 514 so that the outer ring body 508 is correspondingly positioned at the first position or the second position.

Besides, in the present embodiment of the invention, the first metal conductor disposed in the inner ring body 506 is implemented by a metal pad 516, and the second metal conductor disposed in the outer ring body 508 is implemented by a metal protrusion 518.

Compared with the first embodiment, the present embodiment of the invention does employ the use of magnets and further has the advantage of saving cost.

Third Embodiment

Figure 6A:
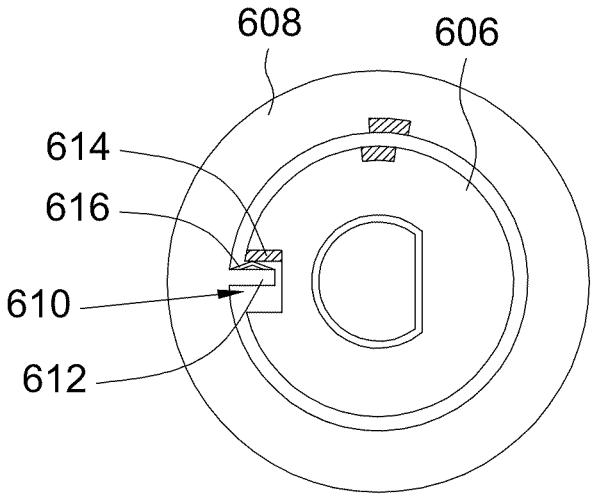
FIG. 6A and FIG. 6B show cross-sectional views of a portion of a lighting system according to a third embodiment of the invention.
Figure 6B:
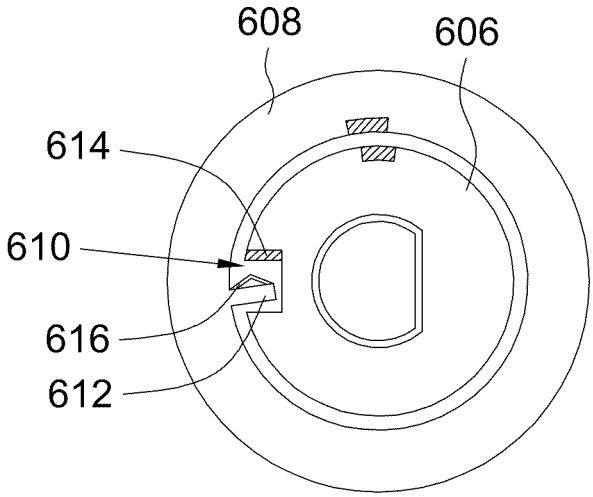

Referring to FIG. 6A and FIG. 6B, cross-sectional views of a portion of a lighting system according to a third embodiment of the invention are shown. FIG. 5A and FIG. 5B differs with FIG. 4A and FIG. 4C of the first embodiment in that the inner ring body 606 of the present embodiment of the invention has a recess 610, the outer ring body 608 has a protrusion 612. The recess 610 is used for receiving the protrusion 612 to limit the outer ring body 608 to rotate between the first position and the second position.

Besides, a first metal conductor 614 is disposed on one side of the recess 610 for receiving power, and the protrusion 612 has a second metal conductor 616 disposed thereon for coupling the light source. When the outer ring body 608 is at the first position, the first metal conductor 614 and the second metal conductor 616 are electrically connected. When the outer ring body 608 leaves the first position, the first metal conductor 614 and the second metal conductor 616 are electrically separated.

One of the first metal conductor 614 and the second metal conductor 616 is a metal elastic piece. In the present embodiment of the invention, the metal elastic piece disposed on the second metal conductor 616 is used for exemplification.

A lighting system with many lighting states is disclosed in the above embodiments of the invention. Through simple operation, the user can promptly change the brightness or the lighting state of the lighting system. The lighting system of the invention indeed provides excellent convenience. Besides, the invention, providing both delightful and ornamental functions, meets the user's needs of a quality living standard.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lighting system, comprising:

a powering rod for providing power;

a first lighting unit, comprising:

a housing;

a light source disposed inside the housing;

an inner ring body disposed in the housing, wherein the inner ring body having a hollowed portion for receiving the powering rod is electrically connected to the powering rod;

an outer ring body disposed on the inner ring body and fixed to the housing, wherein the outer ring body is capable of rotating with respect to the inner ring body for rotating the housing correspondingly, the first lighting unit is in a first lighting state when the outer ring body is rotated to a first position, and the first lighting unit is in a second lighting state when the outer ring body is rotated to a second position; and a first control circuit coupled to the light source; and a control unit connected to the powering rod for providing a control signal to the first control circuit through the powering rod to control the light source;

a second lighting unit whose structure is the same with that of the first lighting unit, wherein the second lighting unit is used for receiving the powering rod, and the control unit sets the addresses of the first lighting unit and the second lighting unit for controlling the first lighting unit and the second lighting unit according to the addresses being set.

2. The lighting system according to claim 1, wherein the first lighting state is a bright state and the second lighting state is a dark state.

3. The lighting system according to claim 2, wherein when the outer ring body is at the first position, the powering rod provides power to the light source through the inner ring body and the outer ring body for enabling the lighting unit to be in the bright state, and when the outer ring body is at the second position, the powering rod stops providing power to the light source for enabling the first lighting unit to be in the dark state.

4. The lighting system according to claim 2, wherein the inner ring body has a first metal conductor, the outer ring body has a second metal conductor, and when the outer ring body is at the first position, the first metal conductor and the second metal conductor are electrically connected, the powering rod provides power to the light source for enabling the first lighting unit to be in the bright state.

5. The lighting system according to claim 4, wherein a first magnet is disposed on the inner ring body, a second magnet is disposed on the outer ring body, and when the outer ring body is rotated between the first position and the second position, the first magnet and the second magnet face each other with the same polarity so that the outer ring body selectively stays at the first position and the second position.

6. The lighting system according to claim 4, wherein the inner ring body has a protrusion, the outer ring body has a recess used for receiving the protrusion to limit the outer ring body to rotate between the first position and the second position.

7. The lighting system according to claim 4, wherein the inner ring body has a protrusion, the outer ring body has a first recess and a second recess, and the protrusion is received in the first recess or the second recess for correspondingly positioning the outer ring body selectively at the first position and the second position.

8. The lighting system according to claim 4, wherein at least one of the first metal conductor and the second metal conductor is a metal elastic piece.

9. The lighting system according to claim 4, wherein the first metal conductor is a metal pad and the second metal conductor is a metal protrusion.

10. The lighting system according to claim 1, wherein the light source further comprises a first light emitter and a second light emitter, and when the first lighting unit is selectively in the first lighting state and the second lighting state, the first light emitter and the second light emitter selectively radiate light and turns off.

11. The lighting system according to claim 1, wherein the first lighting state is a first bright state, the second lighting state is a second bright state, and the first bright state and the second bright state can selectively differ with each other in terms of brightness, color, illuminating direction or light emitting position.

12. The lighting system according to claim 1, wherein a first magnet is disposed at a first point on a relative circumference of the inner ring body, a second magnet is disposed on the outer ring body, when the outer ring body is at the first position, the second magnet faces a second point on the inner ring body, when the outer ring body is at the second position, the second magnet faces a third point on the inner ring body, the first point is located between the second point and the third point, and when the first magnet and the second magnet are opposite to each other, repulsion is generated between the first magnet and the second magnet with the same polarity.

13. The lighting system according to claim 1, wherein the inner ring body has a recess, the outer ring body has a protrusion, and the recess is used for receiving the protrusion to limit the outer ring body to rotate between the first position and the second position.

14. The lighting system according to claim 13, wherein a first metal conductor is disposed on one side of the recess for receiving the power, the protrusion has a second metal conductor disposed thereon for coupling the light source, when the outer ring body is at the first position, the first metal conductor and the second metal conductor are electrically connected, and when the outer ring body is not at the first position, the first metal conductor and the second metal conductor are electrically separated.

15. A lighting system, comprising:

a powering rod for providing power;

a first lighting unit, comprising:

a housing;

a light source disposed inside the housing;

an inner ring body disposed in the housing, wherein the inner ring body having a hollowed portion for receiving the powering rod is electrically connected to the powering rod; and an outer ring body disposed on the inner ring body and fixed to the housing, wherein the outer ring body is capable of rotating with respect to the inner ring body for rotating the housing correspondingly, the first lighting unit is in a first lighting state when the outer ring body is rotated to a first position, and the first lighting unit is in a second lighting state when the outer ring body is rotated to a second position; and a second lighting unit whose structure is substantially the same with that of the first lighting unit, wherein the second lighting unit is used for receiving the powering rod, and the first lighting unit and the second lighting unit are capable of independently rotating with respect to the powering rod.

16. The lighting system according to claim 15, wherein when the first lighting unit is at the first position, the first lighting unit is substantially parallel to the housing of the second lighting unit.

17. The lighting system according to claim 15, wherein when the outer ring body is at the first position, the powering rod provides power to the light source through the inner ring body and the outer ring body for enabling the lighting unit to be in the bright state, and when the outer ring body is at the second position, the powering rod stops providing power to the light source for enabling the first lighting unit to be in the dark state.

18. The lighting system according to claim 15, wherein the inner ring body has a protrusion, the outer ring body has a recess used for receiving the protrusion to limit the outer ring body to rotate between the first position and the second position.

19. The lighting system according to claim 15, wherein the inner ring body has a protrusion, the outer ring body has a first recess and a second recess, and the protrusion is received in the first recess or the second recess for correspondingly positioning the outer ring body selectively at the first position and the second position.

20. The lighting system according to claim 15, wherein the light source further comprises a first light emitter and a second light emitter, and when the first lighting unit is selectively in the first lighting state and the second lighting state, the first light emitter and the second light emitter selectively radiate light and turns off.

* * * * *